United States Patent [19]

Smith et al.

[11] 4,290,493

[45] Sep. 22, 1981

[54] CONFIGURED IMPACT MEMBER FOR DRIVEN FLYWHEEL IMPACT DEVICE

[75] Inventors: James E. Smith, Boulder, Colo.; Gordon P. Baker, Amelia, Ohio

[73] Assignee: Senco Products, Inc., Cincinnati, Ohio

[21] Appl. No.: 73,030

[22] Filed: Sep. 6, 1979

[51] Int. Cl.[3] ..... B25C 1/06

[52] U.S. Cl. ..... 173/124; 227/147

[58] Field of Search ..... 173/13, 49, 53, 124, 173/123; 74/50, 111; 227/146, 147, 8, 131, 80, 110, 111, 129, 133; 124/10; 29/432, 526 R

[56] References Cited

U.S. PATENT DOCUMENTS 4,042,036 8/1977 Smith et al. ..... 173/13

4,060,138 11/1977 Cox et al. ..... 173/49

4,129,240 12/1978 Geist ..... 227/131

*Primary Examiner*—Werner H. Schroeder

*Assistant Examiner*—Andrew Falik

*Attorney, Agent, or Firm*—Frost & Jacobs

[57] ABSTRACT

An impact member for driven flywheel impact devices, such as nailers and staplers, is disclosed which may be configured to tailor the normal force as a function of ram position. A basic configuration is a constant taper, which, as soon as the impact member is actuated by a flywheel, assists in maintaining driving friction on the impact member. The taper may be linear, stepped or curved, and symmetric or asymmetric about the longitudinal axis of the ram, whereby to tailor the impact member speed for different purposes.

7 Claims, 9 Drawing Figures

CONFIGURED IMPACT MEMBER FOR DRIVEN FLYWHEEL IMPACT DEVICE

CROSS REFERENCES TO RELATED APPLICATIONS

This application is related to an application in the names of James E. Smith and Carl T. Becht, Ser. No. 810,903 filed June 28, 1977, entitled "Electro-Mechanical Impact Device", now U.S. Pat. No. 4,121,745, and an application in the name of James E. Smith and Carl T. Becht, Ser. No. 880,448 now U.S. Pat. No. 4,189,080, filed Feb. 23, 1978, entitled "Impact Device".

BRIEF SUMMARY OF THE INVENTION

U.S. Pat. No. 4,042,036 in the names of James E. Smith and James D. Cunningham discloses an electric impact tool wherein a ram or impact member is disposed between a pair of counter-rotating flywheels driven by electric motors. Means are provided to swing one of the flywheels on an arc toward the other flywheel which has a fixed axis, so as to pinch the impact member between the flywheels to propel the impact member in a working stroke.

In U.S. Pat. No. 4,121,745, the counter-rotating flywheels are driven by a single electric motor, and the movable flywheel is moved by cam action, produced by pressing the nose of the tool against a work piece, to a position in which it is spaced from the fixed flywheel by a distance less than the thickness of the ram or impact member. The movable flywheel is spring-biased in this position, and will move against the opposing spring force when the ram enters between the flywheels. The ram is introduced between the flywheels by actuation of the trigger of the tool.

In Ser. No. 880,448 there is one motor driven flywheel on a fixed axis, and a back-up support means which is movable to a position in which it is spaced from the flywheel a distance less than the thickness of the ram by substantially the same means as in U.S. Pat. No. 4,121,745. The ram is brought into engagement between the flywheel and support means by actuation of the trigger of the tool.

In said pending applications, the tip of the ram is beveled to facilitate entry of the ram between the flywheels, or between the flywheel and support means, but thereafter the ram is of uniform thickness.

According to the present invention, the ram or impact member is tapered, and as a result the coefficient of friction between the ram and the flywheel can be reduced from what is required with a constant thickness ram without creating a slipped condition. Engagement of the ram and flywheel can be facilitated by an increase of the normal force exerted by the spring and by inertia, and the taper can provide for increased force later in a drive stroke while at the same time maintaining engagement normal forces at a minimum, thereby minimizing energy losses during engagement. The configuration of the ram may be a linear taper, a stepped taper, or any of a number of curved configurations, and may be symmetrical or asymmetrical about its longitudinal axis, whereby it is possible to tailor the driving characteristics to the exigencies of any particular situation.

DETAILED DESCRIPTION

Figure 1:
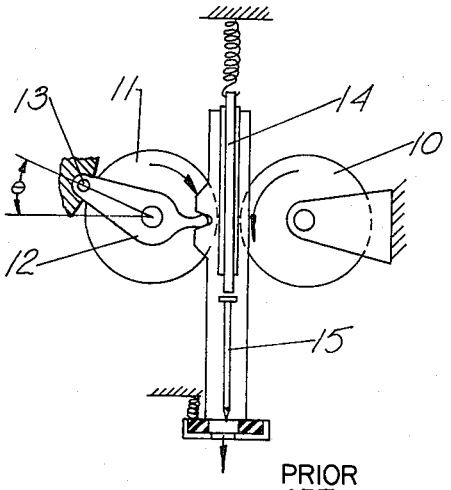
PRIOR ART FIG 1
FIG. 1 is a front cross sectional view of a tool according to U.S. Pat. No. 4,042,036.

U.S. Pat. No. 4,042,036 gives a very complete analysis of the parameters involved in order to make it possible to drive a 16 penny nail into medium hard wood. In that analysis, a peak force of 1,000 pounds (450 kg) is found to be required to accomplish the drive, and approximately 125 foot pounds (17.28 kg-m) of energy is required. It is disclosed that a 3 inch (7.6 cm) solid brass flywheel 1 inch thick, rotating at 7000 rpm. will satisfy these requirements.

The patent further teaches that the ram engaging force between the flywheels against the ram is about three times the work force needed in the ram. This ram engaging force is achieved by mounting the movable flywheel on an arm pivoted above a line normal to the ram and passing through the centers of the flywheels when in operative position. The movable flywheel is swung into operative position, and as it engages the ram and forces it against the fixed axis flywheel, its direction of rotation is such as to tend to roll it further in the engagement direction and thereby to increase the pressure it exerts on the ram.

This arrangement is diagrammatically shown in FIG. 1, wherein the flywheel rotating on a fixed axis is indicated at 10 and the movable flywheel is indicated at 11. The flywheel 11 is mounted on an arm 12 pivoted at 13. The flywheels 10 and 11 rotate in the direction indicated by the arrows, and drive the ram 14 which is pinched between them and which drives the nail 15. The patent teaches that, in order to prevent slippage between the flywheel and ram, the coefficient of friction between the flywheel 11 and ram 14 must be equal to, or greater than, tan $\theta$, where $\theta$ is the acute angle at the intersection of a plane defined by the spin axis of the movable flywheel and its axis of pivotal movement, and a second plane perpendicular to the direction of movement of the ram.

A dynamic analysis of this system reveals that compensation for rapid changes in the required drive force require large angular accelerations of the pivoting flywheel assembly about the suspension axis. When it is borne in mind that drive strokes on the order of one millisecond and relatively large flywheel inertias are involved, it is found that the force required for angular acceleration of the flywheel assembly to provide the necessary friction force may easily be an order of magnitude greater than that required to drive a large nail. In other words the inertia of the flywheel about the suspension axis inhibits clutch regenerative action in the arrangement of FIG. 1.

Figure 2:
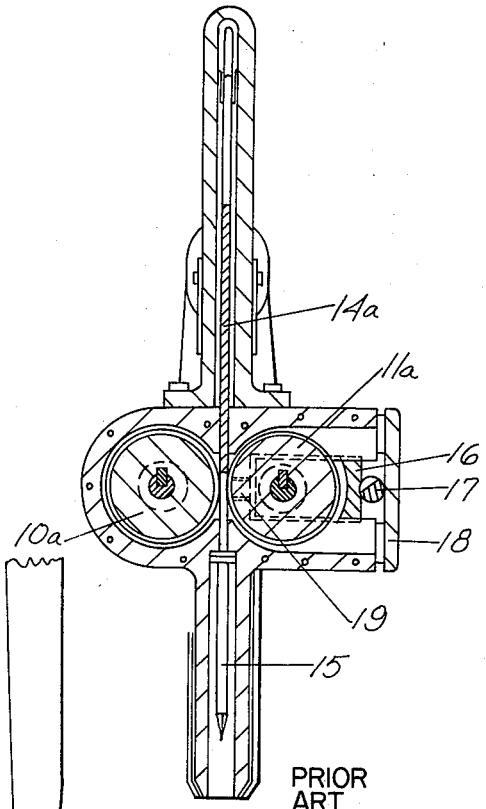
PRIOR ART FIG 2
FIG. 2 is a similar view of a tool according to either of said copending applications.

The devices of the copending applications, Ser. Nos. 810,903 and 880,448, are illustrated in FIG. 2. As can be seen in that FIG. 2, the movable flywheel 11*a* is mounted in a clevis 16 which is moved toward and away from the flywheel 10*a* by the action of a cam 17 operating between the clevis 16 and a spring plate 18. Spring means 19 normally bias the flywheel 11*a*, in its clevis 16, away from the flyweel 10*a*. A comparison of the devices of FIGS. 1 and 2 illustrates the differences between the copending applications and U.S. Pat. No. 4,042,036. In the device of FIG. 1, representative of U.S. Pat. No. 4,042,036, the ram 14, in its starting position, is between the flywheels, which pinch it between them to initiate the working stroke. In the device of FIG. 2, representative of said copending applications, the ram 14*a*, is initially above the bite of the flywheels. The cam 17 moves the flywheel 11*a* toward the flywheel 10*a* to a position in which the space between the flywheels is less than the thickness of the ram. The ram is then introduced between the rotating and closely spaced flywheels, and spring plate 18 yields to permit ram entry between the flywheels. The inertia of the flywheels opposes their separation upon introduction of the ram, and therefore assists in the efficient engagement of the flywheels and ram.

It should be noted that the rams of U.S. Pat. No. 4,042,036 and the said copending applications are of constant thickness, although the copending applications disclose a beveled tip to facilitate the entry of the ram between the flywheels. The ram, beyond the tip, is of constant thickness.

Figure 3:
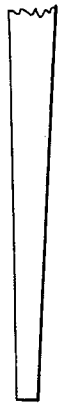
FIGS. 3 to 9 inclusive are fragmentary edge views of a ram showing several possible configurations.

According to the present invention, the ram is tapered as shown in FIG. 3. It should be observed that FIGS. 3 to 9 inclusive, being edge-on-views of a ram, are greatly enlarged, and their configurations are exaggerated. With the use of such a tapered ram in the system of U.S. Pat. No. 4,042,036, the flywheel inertia about its suspension axis 13 (FIG. 1) is helpful and augments the clutch operation. In this situation the flywheel must accelerate angularly in the opposite direction during the millisecond drive time. Now large normal forces are exerted on the ram by virtue of the angular acceleration of the flywheel suspension system, so that the coefficient of friction between the ram and the flywheel can be even less than tan $\theta$ without creating a slip situation. The normal force of the flywheel against the ram is increased during the drive. This increased force aids in the initial engagement, and can provide increased force at a later point in the drive, while keeping the engagement normal forces at a minimumm, so as to minimize energy losses during engagement.

Similarly in the devices of said copending applications (FIG. 2), the inertial force and the spring force, both of which work in favor of maintaining driving friction, are enhanced by the use of a tapered ram, as shown in FIG. 3.

Figure 4:
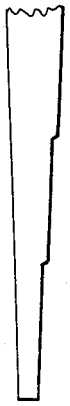
Figure 5:
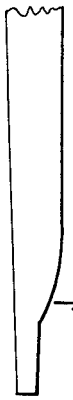
Figure 6:
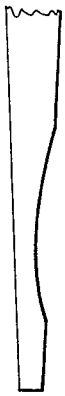
Figure 7:
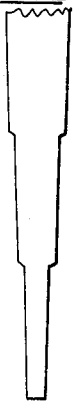
Figure 8:
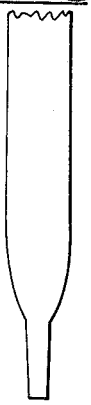
Figure 9:
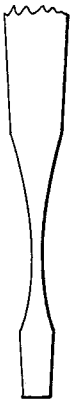

As seen in FIGS. 4 through 6 and FIGS. 7 through 9, the ram taper may be varied. In FIG. 4 the taper is stepped. In FIG. 5 it is increased rather rapidly on a curve; and in FIG. 6 a more complex taper is shown, partly positive and partly negative. FIGS. 4, 5 and 6 illustrate asymmetrical ram tapers. The ram taper may be, of course, symmetrical about the longitudinal axis of the ram, as illustrated in FIGS. 7, 8 and 9.

By varying the taper as suggested in FIGS. 4 through 9, it is possible to tailor the normal force on the ram during ram travel for different purposes, or in other words, to tailor the normal force as a function of ram position.

It will be understood that numerous variations may be made without departing from the spirit of the invention. Therefore no limitation not expressly set forth in the claims is intended, and none should be implied.

What we claim is:

1. An impact device having an impact member driven by means of a driven flywheel, wherein the improvement comprises an impact member whose thickness varies over its entire working length, thus varying the normal force of the flywheel against the impact member as a function of the position of the impact member in its working stroke.

2. An impact member according to claim 1 wherein the variation in thickness of said impact member is a straight-line increase in thickness throughout the working length of said impact member.

3. An impact member according to claim 1 wherein the variation in the thickness of said impact member is a stepped increase in thickness involving at least one step.

4. An impact member according to claim 1 wherein the variation in the thickness of said impact member is in the form of at least one curve.

5. An impact member according to claim 1 wherein the variation in the thickness of said impact member is in the form of a compound curve.

6. An impact member according to claim 1 wherein the variation in thickness of said impact member is symmetric about the longitudinal axis of said impact member.

7. An impact member according to claim 1 wherein the variation in thickness of said impact member is asymmetric about the longitudinal axis of said impact member.

* * * * *